US008627812B2

(12) United States Patent
Murdoch

(10) Patent No.: US 8,627,812 B2
(45) Date of Patent: Jan. 14, 2014

(54) EZ-LAUNCH TWO LITER POP BOTTLE LAUNCHER

(75) Inventor: Dallas Murdoch, Grace, ID (US)

(73) Assignee: Dallas Murdoch, Grace, ID (US)

( * ) Notice: Subject to any disclaimer, the term of this patent is extended or adjusted under 35 U.S.C. 154(b) by 162 days.

(21) Appl. No.: 13/311,293

(22) Filed: Dec. 5, 2011

(65) Prior Publication Data

US 2012/0138037 A1 Jun. 7, 2012

Related U.S. Application Data

(60) Provisional application No. 61/419,477, filed on Dec. 3, 2010.

(51) Int. Cl.
*F41B 11/00* (2013.01)

(52) U.S. Cl.
USPC ..... 124/73; 124/56

(58) Field of Classification Search
USPC ..... 124/71–73, 76, 56
See application file for complete search history.

(56) References Cited

U.S. PATENT DOCUMENTS 2,733,699 A * 2/1956 Krinsky ..... 124/69
2,927,398 A * 3/1960 Kaye et al. ..... 446/212
2,938,512 A * 5/1960 Smolen ..... 124/2
3,046,694 A * 7/1962 Holderer ..... 446/212
3,121,292 A * 2/1964 Butler et al. ..... 446/212
3,342,171 A * 9/1967 Ryan et al. ..... 124/55
3,513,819 A * 5/1970 Phillips ..... 124/64
3,521,564 A * 7/1970 Biehl et al. ..... 102/380
5,415,153 A * 5/1995 Johnson et al. ..... 124/63
5,538,453 A * 7/1996 Johnson ..... 446/176
5,653,216 A * 8/1997 Johnson ..... 124/69
5,839,940 A * 11/1998 Ensmenger ..... 446/212
5,946,742 A * 9/1999 Parker ..... 4/458
6,315,629 B1 * 11/2001 Jones ..... 446/212
6,321,737 B1 * 11/2001 Johnson et al. ..... 124/73
6,679,155 B1 * 1/2004 Yaschur et al. ..... 89/1.813
6,772,745 B2 * 8/2004 McEachen et al. ..... 124/6
6,817,351 B2 * 11/2004 Keller et al. ..... 124/6
6,945,495 B1 * 9/2005 Lund et al. ..... 244/63
7,721,722 B1 * 5/2010 Tulkis ..... 124/73
2007/0012305 A1 * 1/2007 Williams ..... 124/61

* cited by examiner

*Primary Examiner* — Michael David

(57) ABSTRACT

A toy rocket launcher is adapted to pressurize a container, such as a two-liter bottle, and launch the pressurized container upon release of an internal release mechanism. The internal release mechanism locks the bottle rocket in place and releases it with a slight pull on a string. A tire valve may permit a user to pressurize the container with an air pump, such as a bicycle pump or an air compressor. An optional pressure gauge may be provided to monitor pressure in the container.

6 Claims, 3 Drawing Sheets

EZ-LAUNCH TWO LITER POP BOTTLE LAUNCHER

CROSS-REFERENCE TO RELATED APPLICATIONS

This application claims the benefit of priority of U.S. provisional patent application No. 61/419,477, filed Dec. 3, 2010, the contents of which are herein incorporated by reference.

BACKGROUND OF THE INVENTION

The present invention relates to toy rocket launchers and, more particularly, to a two-liter bottle rocket launcher that has an internal release mechanism.

Many current pressurized launching toys rely on a release after an unpredictable air pressure is pumped into a rocket, such as a two-liter bottle.

Other toys rely on removable devices that must be pulled away from the bottle rocket in order to release it. These removable devices require a strong pull for release, creating a potentially hazardous situation should the strong pull result in the launcher tipping over. In addition, with the removable devices, there is a possibility that such devices can be damaged or lost.

As can be seen, there is a need for a toy rocket launcher that has an internal release mechanism.

DETAILED DESCRIPTION OF THE INVENTION

Figure 1:
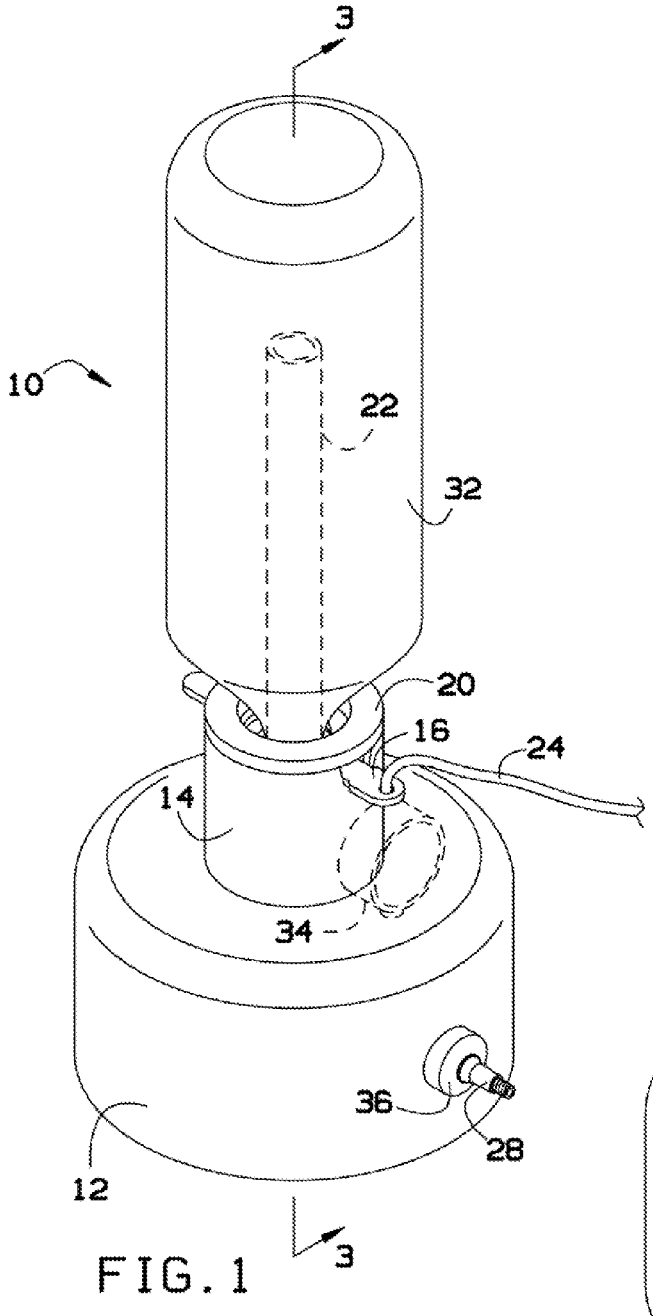
FIG. 1 is a perspective view of a toy rocket launcher according to an exemplary embodiment of the present invention, shown in use.
Figure 2:
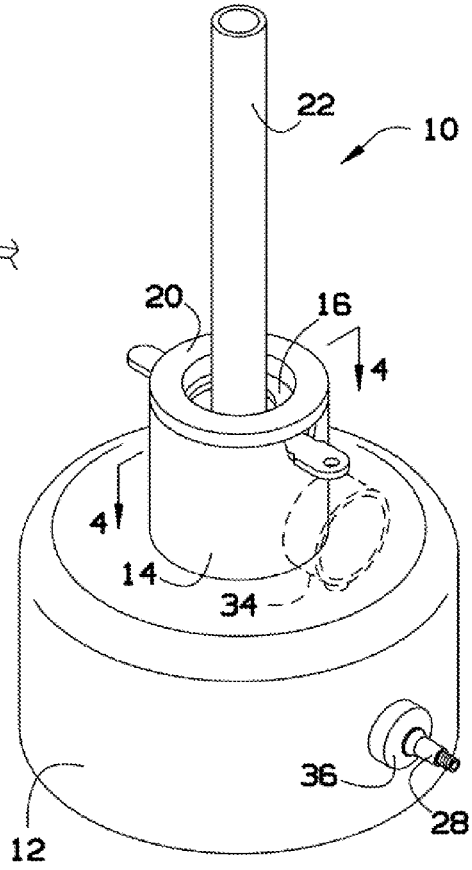
FIG. 2 is a perspective view of the toy rocket launcher of FIG. 1.
Figure 3:
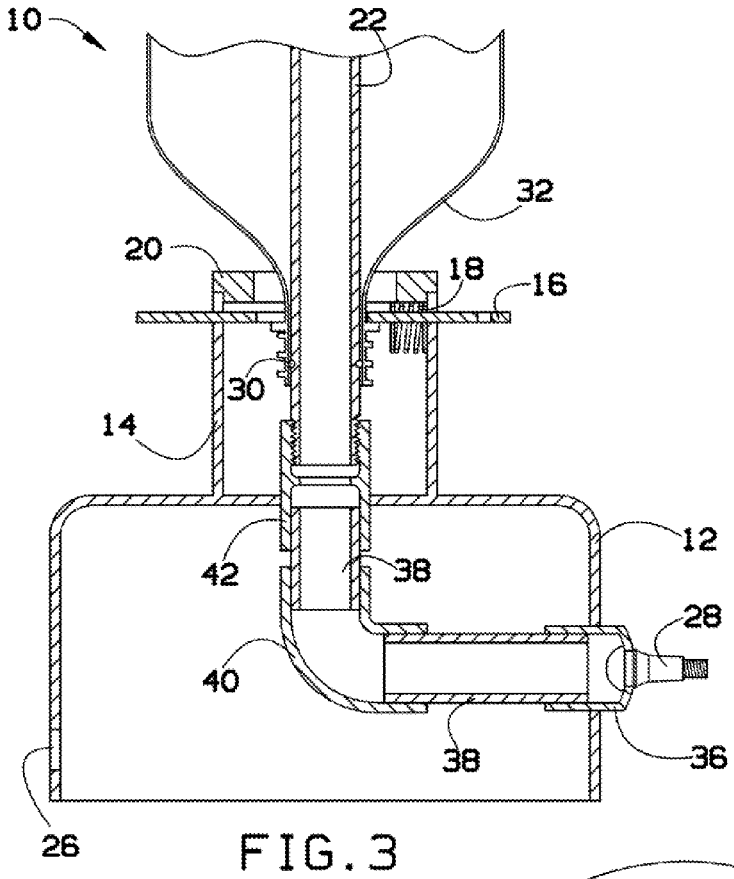
FIG. 3 is a cross-sectional view taken along line 3-3 of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a toy rocket launcher adapted to pressurize a container, such as a two-liter bottle, and launch the pressurized container with an internal release mechanism. The internal release mechanism locks the bottle rocket in place and releases it with a slight pull on a string. A tire valve may permit a user to pressurize the container with an air pump, such as a bicycle pump or an air compressor. An optional pressure gauge may be provided to monitor pressure in the container.

Referring to FIGS. 1 through 6, a launcher 10 may include a base 12 with a launch tube 14 extending from a side thereof.

The base 12 may be a tubular member having at least one solid end from which the launch tube 14 may extend.

In some embodiments, both ends of the base 12 may be solid, forming a hollow interior. The base 12 may be formed of, for example, plastic, metal, composite, or the like. The base 12 may be, for example, shaped similar to a pipe cap, and may have a diameter from about 4 inches to about 8 inches, typically about 6 inches. The launch tube 14 may have a diameter that is about from about 2 inches to about 4 inches in diameter, typically about 2.75 inches in diameter. The launch tube 14 may be attached to the base 12 or may be formed integrally therewith. One or more stake holes 26 may be disposed on sides of the base 12. The stake holes 26 may permit a stake, such as a tent stake, to be used to secure the base 12 to the ground, for example.

A hole may be disposed through the base 12 and a threaded adapter 42 may be disposed to pass through the hole. Pipe 38 and an elbow 40 may connect the threaded adapter 42 with a pipe end cap 36 that passes through a side of the base 12. An air valve stem 28 may be disposed on the pipe end cap 36.

Therefore, when air is delivered into the air valve step 28, the air may pass through the pipe 38 and elbow 40 to be delivered to the threaded adapter 42.

A launch pipe 22 may be threaded into the threaded adapter. The launch pipe 22 may be adapted to fit into an open end of a container 32, such as a two-liter bottle. The launch pipe may be from about 4 to about 9 inches long. An O. ring 30 may be disposed about a perimeter of the launch pipe 22. The O-ring 30 may form a seal about the open end of the container 32 when the container 32 is disposed onto the launch pipe 22.

Figure 4:
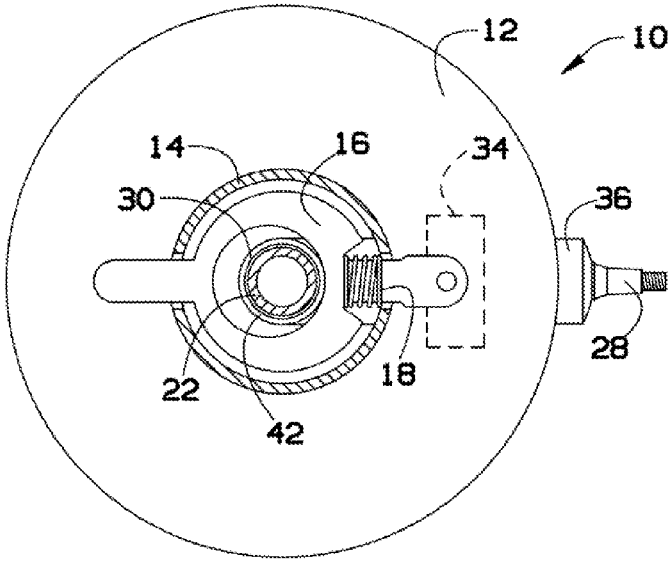
FIG. 4 is a cross-sectional view taken along line 4-4 of FIG. 2.
Figure 5:
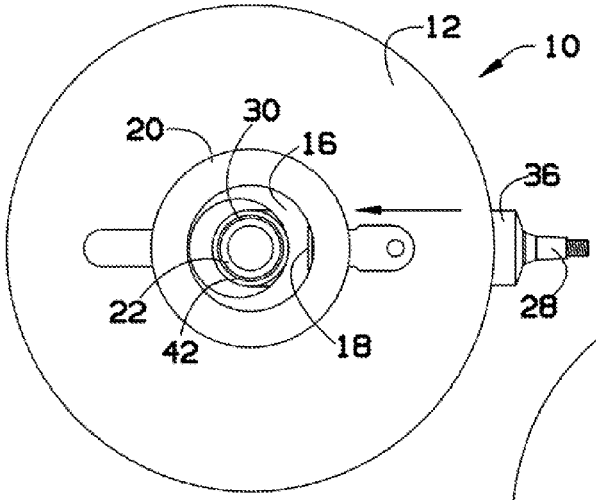
FIG. 5 is a top view of the toy rocket launcher of FIG. 1 with a release mechanism shown in a latched position.
Figure 6:
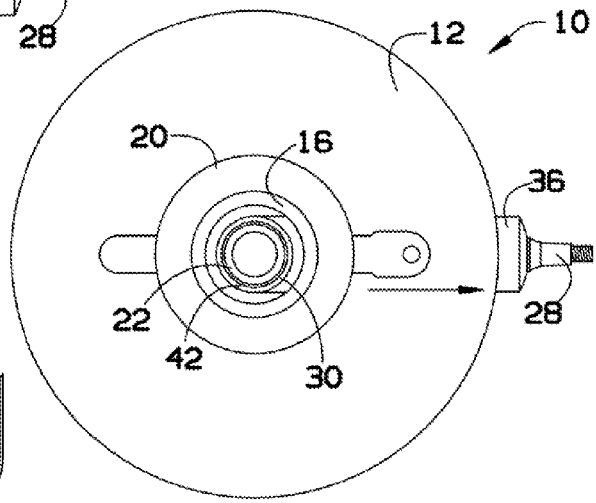
FIG. 6 is a top view of the toy rocket launcher of FIG. 1 with the release mechanism shown in an open position.

A release mechanism 16 may be disposed within the launch tube 14. A release mechanism retainer ring 20 may be used to secure the release mechanism 16 within the launch tube 14. The release mechanism 16 may include a hole, typically a round hole, adapted to allow a lip of a bottle to pass therethrough. A spring 18 may be used to urge the release mechanism 16 in a closed position, as shown in FIGS. 4 and 5. In this position, the release mechanism 16 may catch a lip of the container 32 to retain the container 32 on the launch pipe 22 while the container 32 is pressurized. A pull cord 24 may be connected to one end of the release mechanism 16 to permit a user to pull the release mechanism 16 from a remote location, for example, from about 10 feet away. The pull cord 24 may be pulled to place the launcher 10 into an open position, as shown in FIG. 6.

Figure 7:
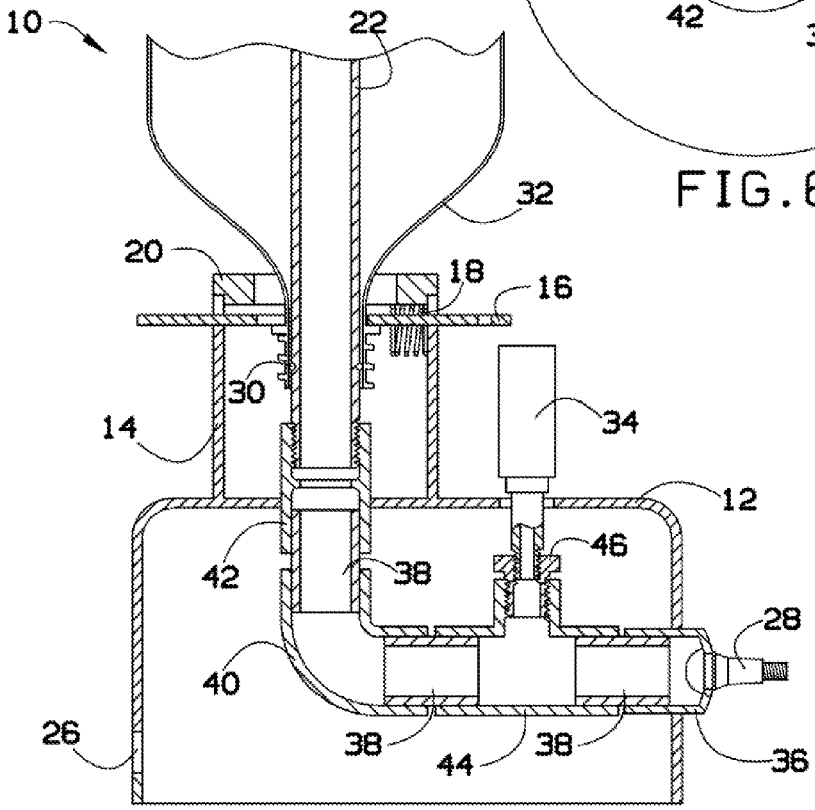
FIG. 7 is a detailed section view of a toy rocket launcher according to an alternate embodiment of the present invention, including an air pressure gauge.

Referring now to FIG. 7, an air pressure gauge 34 may be provided to measure pressure in the container 32. A pipe T-fitting 44 may be placed at the pipe 38 and a threaded pipe bushing 46 may be used to provide a connection to connect the air pressure gauge 34.

To use the launcher 10, a user may place the container 32 onto the launch pipe 22 so that a lip of the container 32 extends beyond the release mechanism 16. The release mechanism 16 may then be urged, with the spring 18, to press against a side of the container 32, where air pressure added to the container 32 may cause the lip of the container 32 to press against the release mechanism 16, preventing launch of the container 32. Air pressure may be added to the container 32 via the air valve stem 28 When a desired pressure is reached (measured, optionally by the air pressure gauge 34), a pull cord 24 may be pulled, causing the release mechanism 16 to be in an open position, allowing the container 16 (and its lip) to pass through the release mechanism 16 and launch from the launcher 10.

While the above description refers to using a two-liter bottle as the rocket to be launched, other containers may be used, provided that they may withstand air pressure (typically up to about 100 psi) and may include a lip to secure the container against the release mechanism prior to launch. The container may be partially filled with water to provide an extra launch boost. For example, the container may be filled up to one-third fill with water. Fins, parachutes, and other flight control items may be added to the container.

It should be understood, of course, that the foregoing relates to exemplary embodiments of the invention and that modifications may be made without departing from the spirit and scope of the invention as set forth in the following claims.

What is claimed is:

1. A launching device comprising:

a base member;

a launch tube extending from one end of the base member;

a release mechanism disposed in the launch tube, the release mechanism movable between a closed position and an open position;

a spring resiliently maintaining the release mechanism in the closed position;

a pull cord connected to the release mechanism;

a release mechanism retainer ring disposed on an open end of the launch tube, the release mechanism retainer ring adapted to retain the release mechanism in the launch tube;

a pressure gauge adapted to measure air pressure within the container;

a launch pipe extending from the launch tube; and a pipe adapted to deliver air into a container disposed on the launch pipe to pressurize air within the container.

2. The launching device of claim 1, further comprising a thread adapter passing through the base member, the thread adapter adapted to threadably retain the launch tube via a thread on one end of the launch tube, the thread adapter connected to the pipe.

3. The launching device of claim 1, further comprising an air valve stem disposed on an end of the pipe.

4. The launching device of claim 1, further comprising a ground stake hole in a side of the base member.

5. A device adapted to launch a two-liter bottle using pressurized air, the device comprising:

a base member;

a launch tube extending from one end of the base member;

a release mechanism disposed in the launch tube, the release mechanism movable between a dosed position and an open position;

a spring resiliently maintaining the release mechanism in the closed position;

a launch pipe having a threaded end, the launch pipe extending from the launch tube;

a thread adapter passing through the base member, the thread adapter adapted to threadably retain the launch tube;

a pipe connected to the thread adapter, the pipe adapted to deliver air into a container disposed on the launch pipe to pressurize air within the container.

6. The device of claim 5, further comprising a pressure gauge adapted to measure air pressure within the container.

* * * * *